United States Patent [19]

Yamazaki

[11] 4,087,019

[45] May 2, 1978

[54] PLUG ARRANGEMENT FOR A CONTAINER

[75] Inventor: Noboru Yamazaki, Chiba, Japan

[73] Assignee: Atsugi Kinzoku Kogyo Co., Ltd., Kyobashi, Japan

[21] Appl. No.: 658,062

[22] Filed: Feb. 13, 1976

[30] Foreign Application Priority Data

Aug. 28, 1975 Japan ..... 50-118440[U]
Aug. 8, 1975 Japan ..... 50-108997[U]

[51] Int. Cl.[2] ..... B65D 51/22

[52] U.S. Cl. ..... 220/258; 215/362; 215/364; 220/270; 220/309

[58] Field of Search ..... 220/306, 307, 256, 257, 220/258, 270, 309, 310, 361, 233; 215/292, 364, 362, 363; 217/108

[56] References Cited

U.S. PATENT DOCUMENTS

| | | | |
|---|---|---|---|
| 734,545 | 7/1903 | Hall | 215/362 |
| 2,551,937 | 5/1951 | Gallagher | 215/364 |
| 2,662,656 | 12/1953 | Beaubaire et al. | 215/363 |
| 2,908,418 | 10/1959 | Gallay | 220/258 |
| 3,021,976 | 2/1962 | Tracy | 220/307 |
| 3,158,282 | 11/1964 | Housz | 220/257 |
| 3,200,986 | 8/1965 | LaGrutta | 220/307 |
| 3,204,359 | 9/1965 | Karokawa | 215/364 |
| 3,207,830 | 9/1965 | Aldinston | 229/43 |
| 3,286,875 | 11/1966 | Frankenberg | 220/309 |
| 3,458,080 | 7/1969 | Lauvizio | 220/258 |
| 3,557,988 | 1/1971 | Tribe | 220/257 |
| 3,561,631 | 2/1971 | Hatfield | 220/257 |
| 3,685,679 | 8/1972 | Heffran | 220/257 |

FOREIGN PATENT DOCUMENTS

| | | | |
|---|---|---|---|
| 685,397 | 4/1961 | Italy | 215/364 |

*Primary Examiner*—William Price
*Assistant Examiner*—Allan N. Shoap
*Attorney, Agent, or Firm*—Watson, Cole, Grindle & Watson

[57] ABSTRACT

A two-part plug arrangement for a container includes an outer plug of soft resilient material and a mating inner plug of deformable material. The inner plug is seated within the outer plug, and the mating plugs are together seated within an opening of a wall of the container. Such opening has an annular turned-over wall along its circumference, and the outer plug has an annular flange adapted to engage such turned-over wall. The plugs are retained in place by being distorted radially outwardly whereby the outer plug sealingly engages the container opening and the two plugs are in sealing engagement with one another. One of the two plugs has a blind bottom, and upon the removal of the inner plug, the outer plug assumes its initial relaxed shape for removal thereof and reuse if desired.

2 Claims, 3 Drawing Figures

PLUG ARRANGEMENT FOR A CONTAINER

BACKGROUND OF THE INVENTION

This invention relates generally to a plug arrangement for a container, and more particularly to such an arrangement as having two cooperating parts with one of such parts being reusable upon removal of the other of such parts.

In the past, cans containing liquid to be stored for a long period of time or to be transported great distances such as during export, leakage of the contents of the can through the closed opening or the introduction of air through the closed opening have occasionally been experienced, the latter leading to deterioration, change in quality and in extreme cases decomposition of the contents, while the former leading to contamination of the can itself as well as to other surrounding goods. Accordingly, plugs of all types have been proposed for tightly sealing the can opening. Most such plugs are, however, not capable of reuse, are troublesome during installation, and are costly to manufacture.

OBJECTS OF THE INVENTION

It is accordingly an object of the present invention to provide a plug arrangement which reliably seals a can from air and renders the can leakproof so as to thereby avoid leakage during long storage periods as well as during transport.

It is another object of the present invention to provide a plug arrangement which is serviceable during repeated use.

It is a further object of the present invention to provide a plug arrangement which is less costly to manufacture, is removable with ease, and is readily openable for removal of the contents in small quantities from a can.

SUMMARY OF THE INVENTION

To attain these objects, a two-part plug arrangement is provided according to the present invention which includes; an outer plug adapted to be seated in an opening of a liquid can containing metal having an annular turned-over or beaded wall along its circumference, the outer plug having a dish-shaped peripheral wall and an outwardly extending annular flange covering the turned-over wall of the opening and being of a soft resilient material; and a metal inner plug having a dish-shaped peripheral wall and being adapted to be seated within the outer plug in superposed relation in a manner to cover the flange of the outer plug; and at least one of the outer and inner plug having a blind bottom. When it is desired to store the liquid containing can in a warehouse, for example, for a long period of time, with its opening securely plugged, the outer plug and inner plug are seated in the opening of the can as aforedescribed, after which the dish-shaped peripheral wall of the inner plug is forcibly expanded radially outwardly of the plug, so as to form a bulged portion, thereby providing a tight seal between the opening in the can and the plug. To remove the plug from the can, the inner plug is removed upon being deformed thereby causing the bulged periphery of the outer plug to flatten back into its original condition. The outer plug may then be removed and is thereafter reuseable.

The radially outwardly protruding bulged portion which is to be formed when seating the plug in the opening may be of a continuous annular shape or may be of discontinuous local bulges. All that is required for the bulged portion configuration is to bring the outer plug into close contact with the circumference of the opening, thereby providing a tight seal therebetween, and to bring the outer plug and inner plug into close contact with one another, thereby providing a tight seal therebetween.

Where it is difficult to restore the bulged peripheral wall of the outer plug to its original condition, upon removal of the inner plug, the outer plug having a blind bottom may be used, so that the outer plug may be removed with ease by breaking the inner plug.

DETAILED DESCRIPTION OF THE INVENTION

Figure 1:
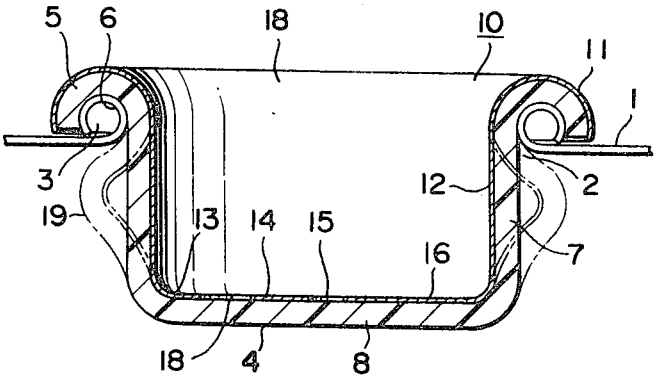
FIG. 1 is a longitudinal sectional view of a two-part plug arrangement seated in an opening of a container, according to an embodiment of the present invention, wherein the outer plug has a blind bottom, and the bulged periphery is shown in phantom outline.
Figure 2:
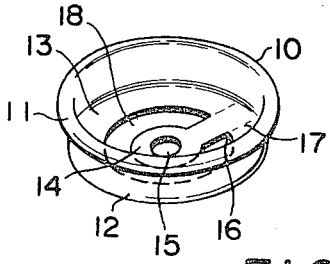
FIG. 2 is a perspective view of the inner plug of FIG. 1.
Figure 3:
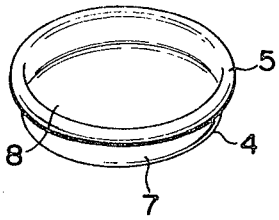
FIG. 3 is a perspective view of the outer plug of FIG. 1.

FIGS. 1 to 3 illustrate an embodiment of the present invention, wherein the outer plug has a blind bottom.

Referring first to FIGS. 1 to 3, shown at 1 is part of a top plate of a container which is provided with a top opening and is molded in accordance with any typical punching process. An opening 2 of the top plate has a turned-over or beaded wall 3 along its circumference which is integral with top plate 1 of the can and which is circular in cross-section. The outer plug shown in FIGS. 1 or 3 is a circular dish-shaped member having an annular flange 5 of a semi-circular shape in cross-section and sufficiently wide to cover turned-over wall 3 of the opening. This outer plug further has a peripheral wall 7 integral with flange 5 and adapted to be seated within opening 2, and a bottom wall 8 integral with peripheral wall 7. Outer plug 4 is made of a soft resilient material, such as rubber or a soft synthetic resin which is readily deformable and is restorable to its original condition upon being deformed.

Inner plug 10 shown in FIGS. 1 or 2 is a circular dish-shaped member having an annular flange 11 adapted to cover the outer surface of annular flange 5 of outer plug 4, a peripheral wall 12 adapted to be seated within peripheral wall 7 of outer plug 4, and a bottom wall 13 integral with peripheral wall 12 and having a central opening 18. The bottom wall is superposed on bottom wall 8 of outer plug 4 when inner plug 10 is seated within outer plug 4. The inner plug is made of metal which is readily deformable but is not restorable to its original form.

Provided on the bottom wall of inner plug 10 is a projection 14, which is connected by means of a stem portion 16 to the outer circumference of the bottom wall and which has a circular opening 15 located in bottom opening 18 concentrically with the circumference of bottom wall 13. The bottom wall is provided with slits of lines of weakening 17 along the opposite longitudinal edges of stem portion 16.

In use, when it is desired to close the can opening with the present plug arrangement for transportation or storage in a warehouse for a long period of time after the charging of a material, such as liquid, to the can, outer plug 4 is first seated within opening 2 with its annular flange 5 sealingly engaging the turned-over wall 3 of opening 2, and inner plug 10 is then seated within outer plug 4, with its flange 11 covering annular flange 5 in engaging relation thereto and with its bottom wall having projection 14 and stem portion 16 superposed on bottom wall 8 of outer plug 4. Thereafter, peripheral wall 12 of inner plug 10 is forcibly expanded radially outwardly thereof by any suitable means extending into the seated plugs.

Consequently, peripheral walls 7 and 12 of the outer and inner plugs which are readily deformable are bulged radially outwardly to present a bent, protuberant contour 19, as shown in phantom outline in FIG. 1. The bent, bulged peripheries of these plugs remain intact by the inner plug, without being restored to the initial condition thereof, thereby providing a perfect air-tight seal between opening 2 and outer plug 4, and thus an air-tight seal between the opening and the outer plug is maintained for a long period of time.

Even if the can is handled roughly during transportation, the plug having the aforedescribed construction effectively protects the contents of the can against leakage through the opening to the outside as well as prevents introduction of air through the opening into the can, which might be a cause of deterioration, change in quality or decomposition of the contents of the can.

In order to remove the plug from the can, projection 14 is first pulled upwardly as by means of hole 15 so as to be bent perpendicularly to bottom wall 8 of outer plug 4, and is then further pulled upwardly. Consequently, projection 14 is torn upwardly along slits 17, and peripheral wall 12 and flange 11 of inner plug 10 are resultantly broken. Thus, inner plug 10 may be removed from outer plug 4 and, as a result, bulged peripheral wall 7 of outer plug 4 is immediately flattened and restored to its initial relaxed shape, whereby the outer plug may be removed with ease from opening 2.

Thus, a plug arrangement has been devised for plugging up the opening of a container and for subsequently removing the plug. However, there are instances when the contents need be emptied at one time or when the contents are to be removed in small quantities time and again, although such depends upon the nature of the contents. In the latter instance, dust might enter the can through the unplugged opening and be intermixed with the residual contents in the can, or the contents might flow out of the opening due to a slight vibration which might be accidentally applied to the can during storage for a short period of time. In such instances, outer plug 4 is available of reuse, so that the identical outer plug may be again seated in opening 2, thereby closing same. Thus, the above-described problem is prevented as the outer plug is frictionally engaged within the opening, so that the residual contents of the can may be stored in safety as well as in a good condition from a sanitary viewpoint.

After the can is unplugged and emptied, only the inner plug is discarded as waste. And, for replugging the can, a new inner plug only is required.

It can be seen that at least the can and the outer plug may be reused thereby resulting in savings of labor and money. The plug construction of the present invention provides a tight seal with easy handling for seating or unseating the plug in or from the can. The molding process for the can is uncomplicated, because only a step for turning over the opening wall is additionally required. The plug when mounted on the can projects slightly from the top plate of the can, but does not interfere with the stacking for storage or transportation.

While the described embodiment represent the preferred form of the present invention, it is to be understood that modifications will occur to those skilled in that art without departing from the spirit of the invention. It is therefore to be understood that within the scope of the appended claims the invention may be practiced otherwise than as specifically described.

What is claimed is:

1. A plug arrangement for a metallic container having an opening in a top plate thereof, and having an annular turned-over wall along the circumference of the opening, comprising;

an outer plug of soft, resilient material capable of being seated in said opening and having an annular flange capable of being seated over said annular turned-over wall of the opening, said plug having a peripheral wall capable of being seated in said opening, and a bottom wall, and said outer plug having a dish-shaped periphery; and, an inner plug capable of being seated in said dish-shaped outer plug and having a flange covering said annular flange of said outer plug, a peripheral wall conforming to the peripheral wall of said outer plug, and a bottom wall capable of being superposed on the bottom wall of said outer plug, said inner plug having a dish-shaped periphery and being made of metal which is readily deformable but not restorable in shape;

said outer plug having a blind bottom, said bottom wall of said inner plug having an opening in the central portion thereof and further having a projection connected at one end by a stem portion to the outer circumference of said inner plug bottom wall and extending at the other end into said opening, said projection being located on said blind bottom when said inner plug is seated in said outer plug in superposed relation thereto, and said dish-shaped peripheral walls of said inner and outer plugs being bulged radially outwardly of the opening, when said inner plug is to be seated in said outer plug seated in said opening in superposed relation to each other, whereby said opening is tightly sealed.

2. A plug arrangement as defined in claim 1, wherein slits are provided in the bottom wall of said inner plug along the opposite longitudinal edges of the stem portion of said projection, and said projection has a central finger hole therein.

* * * * *